US011753917B2

(12) United States Patent
Shetty et al.

(10) Patent No.: US 11,753,917 B2
(45) Date of Patent: Sep. 12, 2023

(54) REAL TIME PARENT CHILD WELL INTERFERENCE CONTROL

(71) Applicant: Halliburton Energy Services, Inc., Houston, TX (US)

(72) Inventors: Dinesh Ananda Shetty, Sugar Land, TX (US); William Owen Alexander Ruhle, Denver, CO (US); Srividhya Sridhar, Bellaire, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 167 days.

(21) Appl. No.: 17/033,428

(22) Filed: Sep. 25, 2020

(65) Prior Publication Data

US 2022/0098963 A1 Mar. 31, 2022

(51) Int. Cl.
*E21B 43/267* (2006.01)
*E21B 49/00* (2006.01)

(52) U.S. Cl.
CPC ..... *E21B 43/267* (2013.01); *E21B 49/008* (2013.01)

(58) Field of Classification Search
CPC ..... E21B 43/267; E21B 49/008
See application file for complete search history.

(56) References Cited

U.S. PATENT DOCUMENTS 9,988,895 B2 6/2018 Roussel et al.
2016/0003020 A1* 1/2016 Sharma ..... E21B 43/267 166/308.1
2016/0326859 A1 11/2016 Crews et al.
2017/0002652 A1 1/2017 Kampfer et al.
2017/0247995 A1* 8/2017 Crews ..... G01V 1/288
2018/0016895 A1* 1/2018 Weng ..... E21B 41/00
2018/0230780 A1* 8/2018 Klenner ..... E21B 43/26
2019/0153841 A1* 5/2019 Randall ..... E21B 49/00
2019/0309618 A1 10/2019 Inyang et al.
(Continued)

FOREIGN PATENT DOCUMENTS

WO WO-2018084870 A1 * 5/2018 ..... E21B 33/13

OTHER PUBLICATIONS

Carey, et al., "Analysis of Water Hammer Signatures for Fracture Diagnostics", SPE Annual Technical Conference and Exhibition, Sep. 28-30, 2015,, 25 pages.
(Continued)

*Primary Examiner* — Crystal J. Lee
(74) *Attorney, Agent, or Firm* — DELIZIO, PEACOCK, LEWIN, & GUERRA

(57) ABSTRACT

When a child well is hydraulically fractured near the depleted reservoir volume surrounding a previously produced parent well, it is economically efficient to deliver proppant to the formation volume and fractures not reached by the parent well. A fracture length, which is the distance fluid travels from the child well to the depleted region, is calculated as a function of fracture stage. From identified trends in fracture length, fracture length for future stages can be predicted. Based on predicted fracture length, the slurry or treatment volume to cause well interference can be estimated. Proppant concentration or fracturing stage design can be adjusted so that the well interference volume is larger than the treatment volume and proppant is efficiently delivered to the child well fractures.

20 Claims, 5 Drawing Sheets

(56) References Cited

U.S. PATENT DOCUMENTS

2021/0277769 A1 9/2021 Shetty et al.

OTHER PUBLICATIONS

Elliott, et al., "Interpreting Inter-Well Poroelastic Pressure Transient Data: An Analytical Approach Validated with Field Case Studies", SPE/AAPG/SEG Unconventional Resources Technology Conference, Jul. 22-24, 2019, Denver, Colorado, USA.
Kampfer, et al., "A Novel Approach to Mapping Hydraulic Fractures Using Poromechanic Principles", American Rock Mechanics Association, 50th US Rock Mechanics / Geomechanics Symposium, Jun. 26-29, 2016, 15 pages.
Rainbolt, et al., "Frac Hit Induced Production Losses: Evaluating Root Causes, Damage Location, Possible Prevention Methods and Success of Remediation Treatments, Part II", SPE Hydraulic Fracturing Technology Conference and Exhibition, Jan. 23-25, 2018, The Woodlands, Texas, USA, 23 pages.
"CA Application No. 3097884 Office Action", dated Apr. 8, 2022, 6 pages.

* cited by examiner

REAL TIME PARENT CHILD WELL INTERFERENCE CONTROL

TECHNICAL FIELD

The disclosure generally relates to earth drilling or mining and to earth drilling, deep drilling, and obtaining oil, gas, water, soluble or meltable minerals or a slurry of materials from wells.

BACKGROUND

In a multi-well field, child (or daughter) wells are drilled subsequent to parent wells in order to access hydrocarbon or mineralogical assets inaccessible via the parent well—either because the volume accessible to the parent well is or has been depleted or because fractures or faults or other formation characteristics limit the accessible volume. It is economically beneficial to drill a child well through the same reservoir or lithology but outside of the depleted region surrounding the older parent well. In hydraulic fracturing (or fracking), a propping agent or proppant is commonly injected into the well during or after fracturing but before fluid extraction commences in order to support the fractures and hold them open and prevent formation collapse. The mass or amount of proppant required to hold the fractures open while formation fluid is drained can correspond to the surface area of the fractures accessible to the current fracture stage.

BRIEF DESCRIPTION OF THE DRAWINGS

Aspects of the disclosure may be better understood by referencing the accompanying drawings.

DESCRIPTION

The description that follows includes example systems, methods, techniques, and program flows that embody aspects of the disclosure. However, it is understood that this disclosure may be practiced without these specific details. For instance, this disclosure refers to flow-distribution in illustrative examples. Aspects of this disclosure can be instead applied to other measures of the deviation of the dominant fracture from the ideal flow-distribution. In other instances, well-known instruction instances, protocols, structures and techniques have not been shown in detail in order not to obfuscate the description.

Overview

Interference between wells can be detected by pressure changes corresponding to fluid flows between the wells. For a fracturing stage in a child well, a corresponding increase in a parent well pressure reflects communication between the child well and parent well. A well-interference time is calculated based on an increase in the parent well pressure as fracking fluid is injected into a child well or child well stage. The well-interference volume is calculated from the well-interference time and the total volume of fluid or slurry injected into the child well or child well stage. The fracture length of the child well stage can be calculated from the well-interference volume and the flow-distribution factor or uniformity index, where the fracture length measures the distance from the child well or child well stage to the depleted region previously drained by the parent well.

For multi-stage wells, the well-interference volume for a fracking stage can be predicted based on the trend in the fracture length for previously fractured stages. An economically efficient rate of proppant delivery can be calculated from the fracture length trend and the mass or amount of proppant for a given stage. If the calculated proppant delivery concentration is outside of the allowed ranges in concentration or if the flow-distribution factor is outside of a range for efficient mining, the fracturing stage design can be updated or altered—with a limited entry design, change in the number or clusters, change in rheology, diverters, etc.—in order to efficiently or effectively mine each stage.

Example Illustrations

Figure 1:
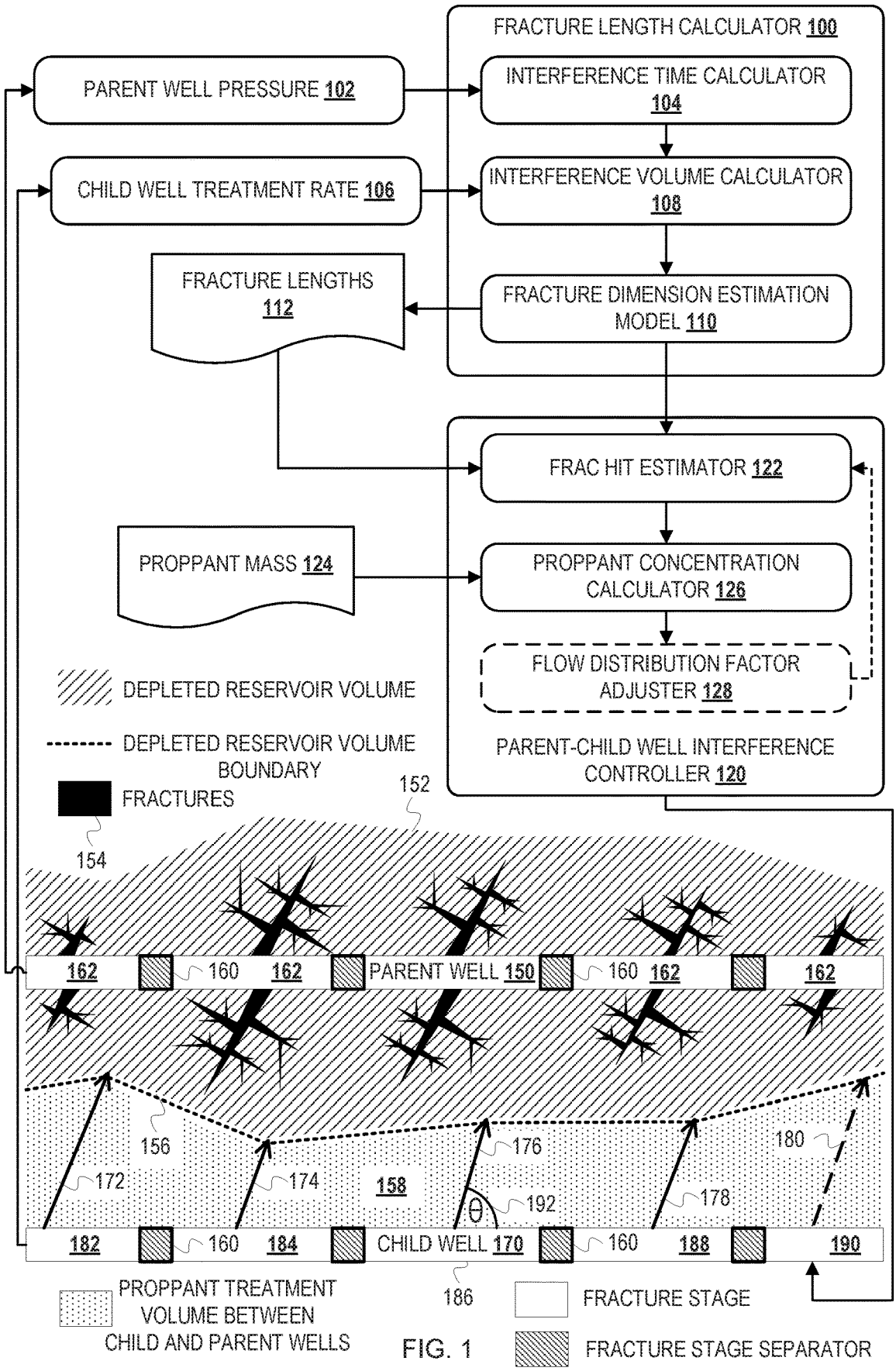
FIG. 1 illustrates an example system for controlling interference between a parent well and a child well.

FIG. 1 illustrates an example system for controlling interference between a parent well and a child well. Parent well 150 represents a well previously drilled through a formation, reservoir, or petrochemical reserve. The parent well 150 is shown as an open hole well with fractures 154 produced in fracture stages 162, which are separated by packers or other fracture stage separators 160, but can also be a cemented or otherwise lined well with perforation clusters or any other fracture type. The parent well 150 is depicted as a horizontal well, but can instead be a vertical well, an angled well, or a well with laterals such that there are both horizontal and vertical sections. The parent well 150 is an established well that has been completed, fractured, and undergone a period of fluid extraction or production. Formation fluid, including oil, gas, water, brine, etc., when extracted or mined leaves behind a depleted reservoir volume 152 which is the volume of the formation previously occupied by the formation fluid that was extracted.

The depleted reservoir volume 152 includes an area surrounding the parent well 150, which may be asymmetrical, and which can vary in size and extent due to formation irregularities, including anisotropy, geological faults, strike and dip angle, etc. and due to fracture stage irregularities, including flow-distribution factor, entry design, number of clusters, flow rate during fracturing, proppant mass, proppant concentration, etc. The depleted reservoir volume 152 can represent the area of the reservoir drained by the parent well 150. The extent of the depleted reservoir volume 152 is contained within the depleted reservoir volume boundary 156, which marks the transition between areas of the reservoir draining to the parent well 150 and areas of the reservoir inaccessible to the parent well 150 under its current fracture and stimulation conditions.

Child well 170, with fracture stages 182, 184, 186, 188, and 190 delineated, represents a new well drilled near the parent well 150. The child well 170 can be drilled outside the depleted reservoir volume 152 surrounding the parent well 150 in order to minimize well interference and thereby increase extraction potential. The depleted reservoir volume boundary is located at a distance of closest approach along the fluid path from each of the fracture stages 182, 184, 186, 188, and 190, where the distance of closest approach can be measured as a fracture length (i.e. fracture lengths 172, 174, 176, 178, 180) corresponding to each of the fracture stages 182, 184, 186, 188, and 190. The fracture length measures the distance fluid travels between the child well 170 and the depleted reservoir volume boundary 156. The fracture length follows the direction of fluid flow, which can correspond to dip and strike angles or other formation characteristics or anisotropy. The fracture length, therefore, may measure a distance at an angle 192 to the child well 170 which may or may not be perpendicular to the child well 170 (where the perpendicular distance represents the geometric distance of closest approach between the child well 170 and the depleted reservoir volume 152). The angle 192 between the fracture length and the child well 170 is also called the fracture orientation and can be measured with respect to well direction (i.e. either downhole or uphole) or another coordinate system and can be have both an in-plane component and out-of-plane component (i.e. dip and strike, axial and azimuthal rotation, etc.) which can vary by fracture stage, within lithology strata or formation layer, or with respect to position along the well.

The child well 170 is shown as a horizontal well drilled below the parent well 150, but both wells may be at the same depth, offset vertically, offset horizontally, angled with respect to one another, curved, or otherwise separated by a constant or variable distance. When the child well 170 is fractured, a treatment volume 158 exists between the child well 170 and the parent well 150. The treatment volume 158 represents the reservoir volume accessible via the child well 170 and outside the depleted reservoir volume 152 of the parent well. The treatment volume 158 also represents the volume not previously hydraulically fractured (fracked) or treated with or supported by proppant. Parent well 150, child well 170, including their fracture stages and their surrounding volumes, are not depicted to scale nor to be taken as exhaustive depictions of all sections and components of such wells.

Proppants can be expensive, especially coated, resin-based, or artificial proppants, both on a per barrel basis and on per job basis (which can exceed millions of pounds of proppant). Economically, the mass or amount of proppant delivered to the fractures of a wellbore stage is more efficient when the proppant is delivered into the fractures and is not overfilled—causing proppant waste—or underfilled—leaving unsupported fractures to potentially collapse. Excess proppant delivered during hydraulic fracturing can also increase well interference by supporting intra-well fractures and enabling communication between fracture of the parent well 150 and the child well 170. By determining the volume more efficiently drained to the child well 170 (that is the treatment volume 158), the volume of fracturing liquid or slurry delivered at each of the fracture stages 182, 184, 186, 188, and 190 can be calculated and adjusted in order to account for changes in the depleted reservoir volume 152 as a function of fracture stage.

For child well 170 as shown, the fracture length 172 corresponds to the fracture stage 182, which is the first depicted fracture stage of the child well 170; the fracture length 174 corresponds to the fracture stage 184; the fracture length 176 corresponds to the fracture stage 186; the fracture length 178 corresponds to the fracture stage 188; and the fracture length 180 (which is shown as a dotted line to represent a predictive fracture length) corresponds to the fracture stage 190).

A fracture length calculator 100 calculates a fracture length for each fracture stage of the child well. The fracture length calculator 100 includes an interference time calculator 104 and an interference volume calculator 108. The interference time calculator 104 determines a time-to-well-interference, $t_{wi}$, during the hydraulic fracturing of a fracture stage of the child well 170 based on a parent well pressure 102. The time-to-well-interference represents the time period over which slurry or other fluid is injected at the child well 170 where the wells are not interfering and ends when interference is detected or determined, for example, via the parent well pressure 102. The parent well pressure 102 is measured in or at the parent well 150, where measurement may take place in the well, in a horizontal section, vertical section, or other angled section, at the surface, or in production or drilling tubing or equipment. The parent well pressure 102 can experience an increase due to hydraulic fracturing or injection at a surrounding well, where the time difference between when hydraulic fracturing begins and the parent well pressure 102 changes is a measure of the time-to-well-interference and can be used to calculate a volume-to-well-interference, $V_{wi}$.

The interference volume calculator 108 determines the volume-to-well-interference based on the time-to-interference calculation of the interference time calculator 104 and a child well treatment rate 106. The child well treatment rate 106 represents a rate of slurry or other hydraulic fracturing fluid delivered to the fracture stage over time. The interference volume calculator 108 integrates the child well treatment rate 106 from the start of hydraulic fracturing to the time when interference between the child well 170 and the parent well 150 is detected, the time-to-well-interference, in order to calculate the volume-to-well-interference, which is the total volume of slurry or fluid injected at the fracture stage.

The fracture length calculator 100 uses a fraction dimension estimation model 110 to calculate the fracture length of the fracture stage of the child well 170 based on the volume-to-well-interference output by the interference volume calculator 108. The volume-to-well-interference can be related to the fracture length via a poro-elastic model, via a planar model, or via another method or model, as will be discussed in further detail in reference to FIG. 2. The fracture length calculator 100 determines fracture lengths 112 as a function of stage. The fracture lengths 112 fluctuates with stage—i.e. fracture length measures the distance fluid travels between the child well 170 and the depleted reservoir volume of the parent well 150 as a function of stage. The fracture length can vary based on well conditions, conditions during the parent well fracturing, formation type, formation anisotropy, well orientation, etc. The fracture lengths 112 can be output in order to evaluate fracturing of the child well 170.

A parent-child well interference controller 120 operates on the output of the fracture length calculator 100 to control the interference between the parent well 150 and the child well 170 by adjusting the parameters of a fracture stage based on the fracture lengths 112 at a stage. The parent-child well interference controller 120 can operate directly on the information determined by the fracture length calculator 100 (such as on the volume-to-well-interference instead of on the fracture lengths 112), and optionally the fracture length calculator 100 can be contained within the parent-child well interference controller 120. The parent-child well interference controller 120 can also operate on the fracture lengths 112 output as a data set by the fracture length calculator 100.

The parent-child well interference controller 120 includes a frac hit estimator 122, a proppant concentration calculator 126, and optionally a flow distribution factor adjustor 128. The frac hit estimator 122 determines if a trend or progression is present in the fracture lengths 112, or optionally in volume-to-well-interference data. The frac hit estimator 122 then estimates when the frac hit occurs in the next stage, where the frac hit is an event where a neighboring well (in this case the parent well) experiences a "hit" or pressure increase due to the hydraulic fracturing treatment of a stage of a new well (in this case the child well). The frac hit estimator 122 estimates the volume-to-well-interference for a fracture stage based on the volume-to-well-interference or fracture lengths of the previous fracture stages. In one or more embodiments, the frac hit estimator 122 can determine that the fracture length is increasing as a function of stage, decreasing as a function of stage, or substantially unchanged from stage to stage. In one or more embodiments, the frac hit estimator 122 can determine that no trend in fracture length is detected, or detected above background fluctuations, and select the calculated volume-to-well-interference of the previous stage to estimate the current stage frac hit.

The proppant concentration calculator 126 determines an economically efficient proppant concentration to be delivered to the fracture stage based on the volume-to-well-interference estimated by the frac hit estimator 122 and based on a proppant mass 124. The proppant mass 124 is a mass or amount of proppant to be delivered to the fracture stage. The proppant mass 124 for a fracture stage is determined based on the selected proppant's properties, the formation type, interactions between the formation and the proppant, hydraulic fracturing characteristics, etc. The proppant concentration calculator 126 determines a concentration for the proppant in the slurry or other hydraulic fracturing fluid based on the proppant mass 124 per estimated volume-to-well-interference. The proppant concentration calculator 126 can also determine if the calculated proppant concentration is within bounds or acceptable ranges. The bounds on allowable proppant concentrations can be preselected, can be determined based on proppant solubility limits, based on fluid characteristics, such as viscosity, density, surface tension, etc., based on formation characteristics, or can be related to a flow-distribution factor, where the flow-distribution factor is a measure of the uniformity of fluid transport through the fractured formation system. If the proppant concentration calculator 126 determines, based on the proppant mass 124 and the estimated volume-to-well-interference, that the proppant concentration is either too high or too low, the proppant concentration calculator 126 can set the proppant concentration to either the highest concentration of the allowable range (for calculated proppant concentrations that are too high) or to the lowest concentration of the allowable range (for calculated proppant concentrations that are too low).

Embodiments can include a flow distribution factor adjuster 128 as part of the parent-child well interference controller 120. The flow distribution factor adjuster 128 is triggered when the proppant concentration calculator 126 determines that the calculated proppant concentration is out of bounds. The flow distribution factor adjuster 128 can determine that a change in the flow-distribution factor, which corresponds to a change in fracture stage design, can expand the range of allowable proppant concentrations. The flow-distribution factor can be adjusted by changing the fracture stage design to a limited-entry design, changing the number of clusters, using dropping diverters, changes in flow rate or rheology, etc. Once the flow distribution factor adjuster 128 triggers a change in fracture stage design, the frac hit estimator 122 determines an estimated volume-to-well-interference for the updated fracture stage and flow-distribution factor. This cycle can continue iteratively until a termination criterion is satisfied (e.g., a set number of iterations are reached or until a combination of fracture stage design and an allowable calculated proppant concentration are determined).

Figure 2:
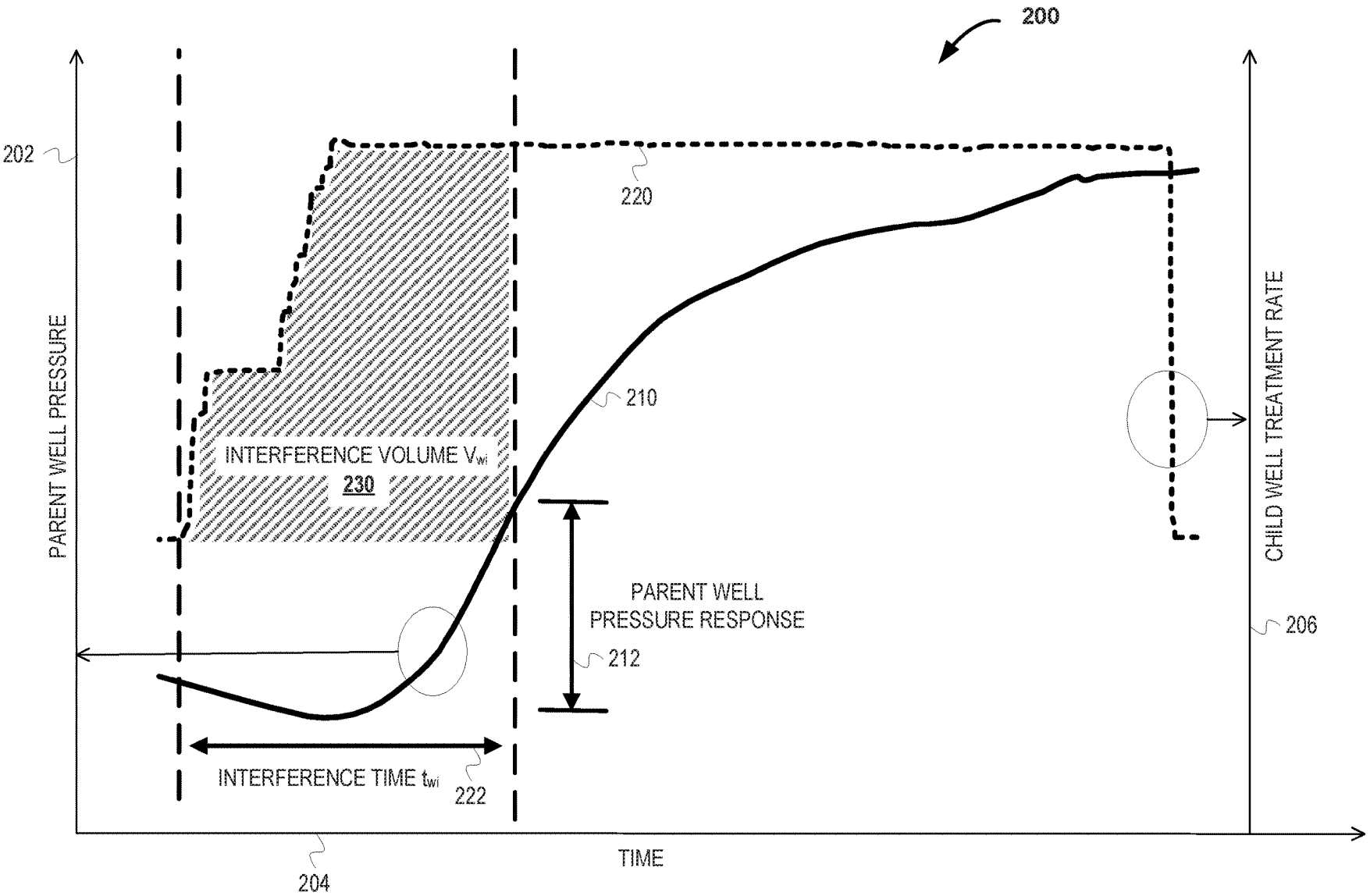
FIG. 2 depicts an example graph of parent pressure and slurry rate as a function of time.

FIG. 2 depicts an example graph of parent pressure and slurry rate as a function of time. Graph 200 contains curve 210, which is a plot of pressure in a parent well, and curve 220, which is a plot of treatment rate in a child well, plotted as functions of time on the x-axis 204. The curve 210 for pressure over time in the parent well is plotted versus the y-axis 202, which corresponds to parent well pressure. The curve 220 for treatment rate over time in the child well is plotted versus the secondary y-axis 206, which corresponds to child well treatment rate.

The time-to-well-interference $t_{wi}$ can be calculated from the curve 210. A frac hit, or well interference, can be detected due to a sharp rise in parent well pressure of a predetermined magnitude such as ~100 psi, shown in the graph 200 as parent well pressure response 212. A delta δ can selected to detect well interference as shown in Equation 1, below:

$$P_{wi}=P_0+\delta \tag{1}$$

where δ is the well interference threshold, $P_0$ is the initial parent well pressure, and $P_{wi}$ is the parent well pressure corresponding to well interference. The initial parent well pressure may fluctuate due to measurement artifacts or well conditions, so $P_0$ can also represent a smoothed or baseline parent well pressure.

In one or more embodiments, the well interference threshold can detect a sharp rise in parent well pressure (i.e. a change in derivative), in addition to or instead of a magnitude of change in parent well pressure, as shown in Equation 2, below:

$$\frac{dP}{dt} \geq \epsilon \tag{2}$$

where the derivative of pressure with respect to time (dP/dt) is compared to a minimum derivative threshold ∈ in order to detect a sharp change in parent well pressure. The interference pressure is then approximated by Equation 3, below:

$$\left.\frac{dP}{dt}\right|_{P_{wi}} \geq \epsilon \tag{3}$$

where the derivative evaluated at the parent well pressure corresponding to interference $P_{wi}$ is greater than the minimum derivative threshold ∈. The parent well pressure corresponding to interference $P_{wi}$ can be calculated by other variations or combinations of either of these techniques.

The time-to-well-interference $t_{wi}$ is directly calculable from the time at which the parent well pressure corresponding to interference $P_{wi}$ is detected in the parent well, and is shown in the graph 200 as the interference time 222. The time-to-well-interference $t_{wi}$ is the length of time or instance in time for which well interference is detected, and can be calculated based on the parent well pressure corresponding to interference $P_{wi}$ using Equation 4, if length of time can be measured as a function of pressure, or using Equation 5, where pressure is a function of time and $t_{wi}$ is found from the inverse of the pressure function when pressure is equal to $P_{wi}$, as shown below:

$$t_{wi}=t(P_{wi}) \tag{4}$$

$$P(t_{wi})=P_{wi} \tag{5}$$

where P(t) is pressure as a function of time and t(P) is time expressed as a function of pressure, or the inverse of the P(t) function.

The volume-to-well-interference can be calculated from the time-to-well-interference and the child well treatment rate or slurry rate, displayed by the curve 220. The volume-to-well-interference, $V_{wi}$, can be calculated from the total amount of treatment fluid added to the fracture stage before a frac hit or interference is detected. The volume-to-well-interference, shown in the graph 200 as the interference volume 230, can be calculated using Equation 6, below:

$$V_{wi}=\int_0^{t_{wi}} Q(t)dt \tag{6}$$

where Q(t) represents the child well treatment rate or slurry rate (in units of volume per unit time), and where t=0 corresponds to the beginning of the hydraulic fracturing operation and $t_{wi}$ is the time-to-well-interference.

A fracture length can be calculated based on the volume-to-well-interference and either a poro-elastic model, where pressure trends in the parent and child wells reveal information about the fracture enabling communication between the wells, or a planar model and a flow-distribution factor measuring the uniformity of fractures and flow surrounding the child well. Use of a poro-elastic model enables a fracture length, which is the distance fluid flows from the child well to the depleted region surrounding the parent well, to be calculated based on knowledge of the fracture stage design and pressure trends in the parent well. The poro-elastic model calculates a poro-elastic response by comparing measured pressure in the parent or offset well after a hydraulic fracturing or other treatment even in the treatment or child well to the pressure trend observed in the parent or offset well in the absence of treatment or hydraulic fracturing of the child well.

To calculate a poro-elastic response, the pressure is measured in the offset or parent well. If the pressure is measured at the surface, the measured pressure can be corrected (for example, by using the hydrostatic pressure) to determine the bottom gauge, or pressure at depth in the well under the column of fluid within the well. A pressure trend can also be identified as the natural response (or pressure trend) in the offset or parent well in the absence of pumping or treatment in the child well. If the offset or parent well was recently fractured, shut-in, etc. the pressure response or decline may include well-known zones or trends, such as pressure-dependent leak-off (PDL), fracture closure, final leak-off, etc. A typical trend can be fitted or extrapolated from existing data or previous similar responses in order to determine a trend line. If the offset or parent well is a producing well, the pressure history can be used to determine a natural response or pressure trend. The poro-elastic response is then calculated as the difference between the measured pressure and the trend in the pressure as shown in Equation 7, below:

$$\tilde{p}=p_m-p_t \tag{7}$$

where $\tilde{p}$ is the poro-elastic response, $P_m$ is the measured pressure, and $P_t$ is the pressure trendline, which can be calculated or previously measured.

The poro-elastic response can then be used to calculate fracture dimensions, where the poro-elastic response can be assumed to depend on fracture and formation properties, such as those shown in Equation 8, below:

$$\tilde{p}=f(P_{net},v,H,L,\theta,x,y,z) \tag{8}$$

where $P_{net}$ is the net fracture pressure, v is Poisson's ratio for the formation, H is the height of the fracture, L is the half-length of the fracture, θ is the fracture orientation, and (x,y,z) are the relative coordinates of the observation location to the fracture. Poisson's ratio, v, is known from logging (including measurement while drilling (MWD) or logging while drilling (MWD)) or can be determined or looked up from a formation database or other geological reference. The distance from the observation location (which is the parent or offset well) to the fracture initiation point in the child or treatment well is determined by the fracture stage construction, design, and relative position of the parent and child well. The fracture orientation, θ, is determined by the formation principal stress orientation and can be a known, determined based on logging or previous fracturing, or can be calculated by comparing poro-elastic responses of two observations, where the fracture orientation should be relatively constant when comparing the poro-elastic response of a parent well to different stages in a child well. The net fracture pressure, $P_{net}$, can be estimated using instantaneous shut in pressure (ISIP) and the minimum stress ($\sigma_{min}$). If the region of fracturing has well-defined stress confinement, then the fracture height, H, can be estimated. If the fracture height is not known, then a correlation between fracture height and net fracture pressure, such as one determined using a planar model like the Perkin-Kern-Nordgren (PKN) model, can be used. In cases where the poro-elastic model depends on known quantities and upon an unknown length, L, the fracture length can be estimated directly from the poro-elastic response.

A planar model such as the PKN model can be used to determine a fracture length based on the flow-distribution factor, c, or uniformity index which is a measure of the uniformity of flow in the formation surrounding the fracture stage. The flow-distribution factor can be defined as the ratio of the flow-rate in the dominant cluster (of the fracture stage) to the flow-rate at the surface, which is therefore a measure of how much of the flow is controlled by the dominant cluster and measures uniformity of flow through the formation and fractures. Using the PKN model, a fracture length can be calculated as shown in Equation 9, below:

$$L_f = 0.39\left(\frac{(cV_{wi}/t_{wi})^3 E'}{\mu H^4}\right)^{\frac{1}{5}} t_{wi}^{\frac{4}{5}} \tag{9}$$

where H is a constant height for the fracture, μ is density, and E' is the plane strain Young's modulus related to Young's modulus as shown in Equation 10.

$$E' = \frac{E}{1-\nu^2} \tag{10}$$

Where E is Young's modulus of the formation and v is Poisson's ratio for the formation. Further, the PKN model assumes that the half-length of the fracture (i.e. $L_f$), the fracture height H, and the variable fracture width w are related by the relationship given in Equation 11, below:

$$L>H>>w \tag{11}$$

The poro-elastic model and a planar model can be combined to calculate the fracture length and the flow-distribution factor. For example, the flow-distribution factor can be calculated from the fracture length, where the length is calculated from the poro-elastic model. The fracture length calculated using the poro-elastic model can be compared to a planar model estimate, like that from the PKN model, in order to calculate the deviation of the dominant fracture from the ideal flow-distribution scenario. The comparison between the dominant fracture flow and the ideal flow-distribution can be used to calculate the flow-distribution factor.

The flow-distribution factor, c, can be estimated based on other measurement methods or models. For example, the flow-distribution factor can be estimated based on distributed acoustic sensing (DAS) measurements acquired at the child or treatment well. The fracture length and other dimensions can also be measured or estimated from microseismic measurements of the treatment well and formation.

For a child well with multiple stages, a fracture length can be calculated for each completed stage. The depleted reservoir boundary between the parent well and the child well can be determined based on the fracture length, relative wellbore positions, and optionally fracture orientation. For the next stage to be hydraulically fractured, a projection or estimate of the distance to the depleted reservoir boundary can be calculated. First, a fracture length for well interference (i.e. for a frac hit to occur) is determined. Once the projected fracture length is determined, the projected volume-to-well-interference can be estimated using Equation 12, below:

$$V_{wi,j+1}=f(V_{wi,j},L_{f,j},L_{f,j+1},c_j,c_{j+1},Q_j,Q_{j+1},\ldots) \tag{12}$$

where $V_{wi,j}$, $L_{f,j}$, $c_j$ and $Q_j$ are the volume-to-well-interference, fracture length, flow-distribution factor, and slurry or treatment rate for the fracture stage j, respectively, and $V_{wi,j+1}$, $L_{f,j+1}$, $c_{j+1}$ and $Q_{j+1}$ are the estimated or projected volume-to-well-interference, fracture length, flow-distribution factor, and slurry or treatment rate for the fracture stage j+1, respectively.

A data-based model can be developed on historical data, including previous stages, to learn the correlation between fracture length trend and volume-to-well-interference trends. A planar model such as the PKN model can be used to simplify the relationship between projected fracture length and projected volume-to-well-interference, as shown in Equation 13, below:

$$V_{wi,j+1} \approx \left(\frac{L_{f,j+1}}{L_{f,j}}\right)^{\frac{5}{4}}\left(\frac{Q_{j+1}}{Q_j}\right)^{\frac{1}{4}}\left(\frac{c_j}{c_{j+1}}\right)^{\frac{3}{4}}V_{wi,j} \tag{13}$$

In instances where fracture stage j and fracture stage j+1 have identical designs, the relationship of Equation 13 can be further simplified as shown in Equation 14, below:

$$V_{wi,j+1} \approx V_{wi,j}\left(\frac{L_{f,j+1}}{L_{f,j}}\right)^{\frac{5}{4}} \tag{14}$$

Based on these relationships, the projected volume-to-well-interference can be obtained based on a determined trend or gradient in the fracture length across stages. Optionally, a machine learning model can be trained on data from previous stages, such as fracture length and slurry or treatment volume to frac hit, in order to predict volume-to-well-interference for stages to be fractured.

Based on the projected volume-to-well-interference, the proppant ramp schedule (i.e. the programed treatment or slurry rate as a function of time) is modified. The proppant ramp schedule can be adjusted towards a more economically efficient schedule based on the projected volume-to-well-interference for stages to be fractured. When a projected volume-to-well-interference is larger than the volume to be pumped based on the proppant ramp schedule, the design can be deemed valid and remain unchanged. However, when a projected volume-to-well-interference is smaller than the volume to be pumped based on the proppant ramp schedule, the design can be deemed inefficient and the design of the proppant ramp schedule adjusted by increasing the proppant concentration in order to ensure that the proppant mass for the stage is delivered before well interference (or a frac hit) occurs.

Proppant concentration has real world limitation, including solubility, viscosity, density, etc. that prevent infinite increase of proppant mass per slurry or treatment volume. When the projected volume-to-well-interference is smaller than the volume to be pumped, proppant concentration adjustment is not enough to ensure that the proppant mass is delivered before well interference occurs. In such cases, or when the calculated proppant concentration is unacceptable or outside of limits for other reasons, the design of hydraulic fracturing for the stage to be fractured can be changed in order to adjust the flow-distribution factor or otherwise change the projected volume-to-well-interference. The projected volume-to-well-interference can be increased by improving cluster efficiency, by increasing the number of clusters, etc.; and the flow-distribution factor can be controlled or adjusted via changes in flow rate, rheology, or the like with dropping diverters or other intra well flow control devices.

Figure 3:
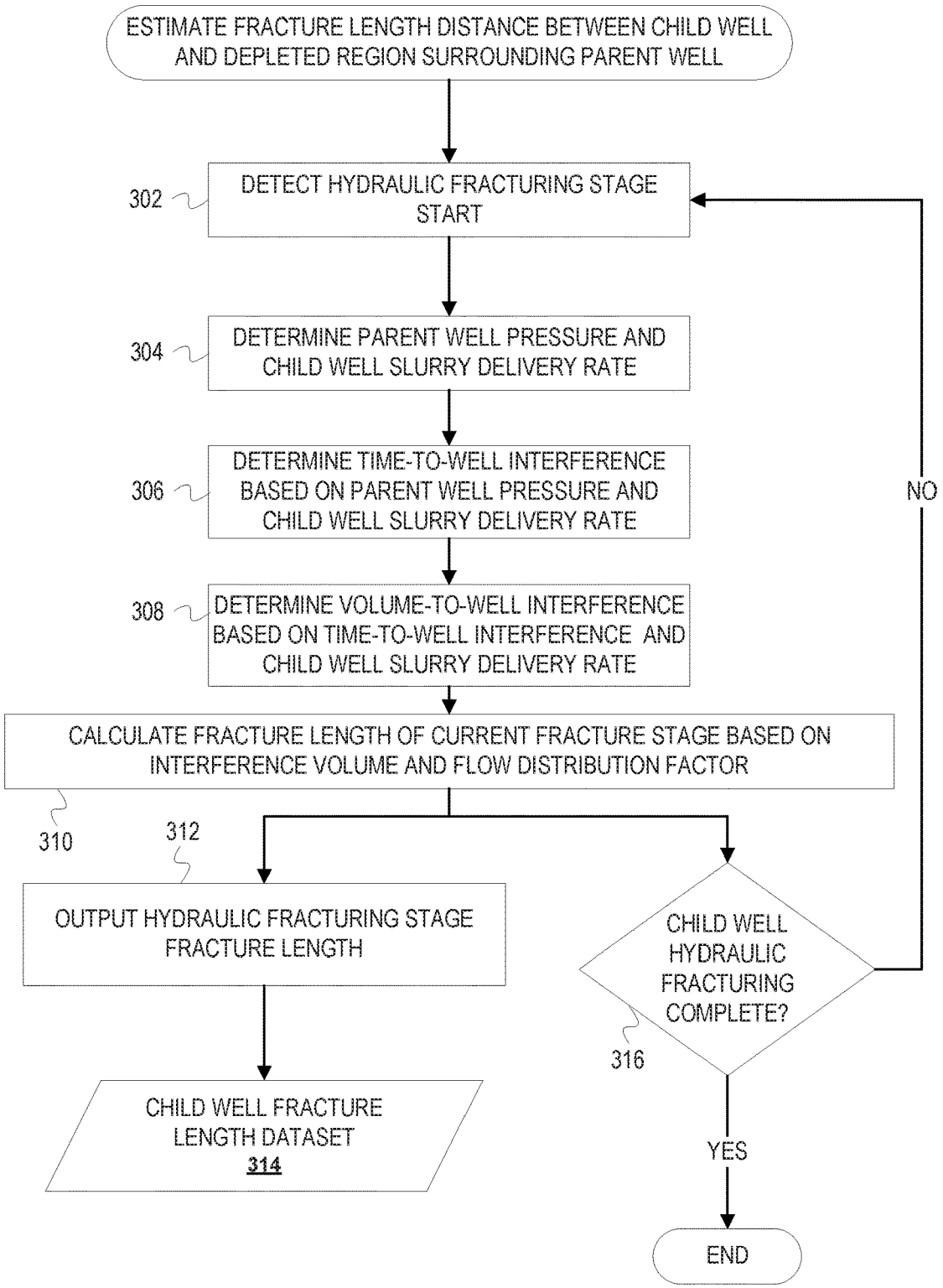
FIG. 3 is a flowchart of example operations for determining a fracture length distance between the child well and a depleted region surrounding e parent well.

FIG. 3 is a flowchart of example operations for estimating a fracture length distance between the child well and a depleted region surrounding the parent well. The operations are described as being performed by a fracture length calculator. However, program code naming, organization, and deployment can vary due to arbitrary programmer choice, programming language(s), platform, etc. The fracture length calculator can be a processor, program code that determines a fracture length based on measured or input data, or a modeling, analysis, or graphing program or includes such programing in order to determine fracture length based on pressure and treatment rate.

At block 302, the fracture length calculator detects the start of a hydraulic fracturing operation. The fracture length calculator can detect the beginning of slurry delivery or other flowrate changes at the child well, can be triggered by program code in the hydraulic fracturing monitoring or controlling software or code, can be triggered manually, or can operate on data output by the flowrate controllers of the child well and pressure measurement system of the parent well.

At block 304, the fracture length calculator determines parent well pressure and slurry delivery or treatment rate in the child well as a function of time. The pressure at the parent well can be measured by an analysis apparatus and input to the fracture length calculator. The slurry delivery or treatment rate can be measured by a flow rate measurement device or detector and also input to the fracture length calculator. The pressure in the parent well and slurry delivery or treatment rate in the child well are compared on the same time scale. Time scales for the pressure in the parent well and slurry delivery or treatment rate in the child well may be measured on different time scales. In such a case, the fracture length calculator determines an offset such that the pressure in the parent well and slurry delivery or treatment rate in the child well can be compared on the same time scale or in absolute time.

At block 306, the fracture length calculator determines the interference time (or time-to-well-interference). The fracture length calculator determines a pressure change or gradient corresponding to well interference, i.e. for which a frac hit is detected in the parent well pressure, such as using the methods detailed in Equations 1-3. The fracture length calculator determines the interference time based on the time when the pressure change corresponding to well interference is detected, as shown in Equations 4-5. The interference time can be a point in time (i.e. 16:45.05 on the day of fracture treatment) or a length of time (i.e. 5 hours 27 minutes 37 seconds), and may account for an offset in time recordation between the pressure measurement in the parent well and the flow rate measurement in the child well.

At block 308, the fracture length calculator determines the interference volume (or volume-to-well-interference). The interference volume measures the amount of fluid—treatment fluid or slurry—pumped into the child well fracture stage between when treatment begins and when well interference or a frac hit is detected. The interference volume can be determined by integrating the treatment or slurry rate after the interference time is calculated, or integration can be performed as the flowrate is measured such that the interference time corresponds directly to an interference volume. The interference volume can be calculated using Equation 6 or another appropriate method.

At block 310, the fracture length calculator calculates a fracture length for the child well fracture stage based on the interference volume and flow-distribution factor. The fracture length can be calculated using a poro-elastic model (as described in Equations 7-8), a planar model (such as the PKN model described in Equations 9-11) or other appropriate approximation or model. A flow-distribution factor, c, can be calculated from the poro-elastic response, from a planar model, based on other methods such as DAS flow monitoring of the treatment well, micro-seismic measurements, etc. From block 310, flow continues to both block 312 and block 316.

At block 312, the fracture length calculator outputs the fracture length for the hydraulic fracturing stage. The fracture length can be output to the parent-child well interference controller, to an operator, to the hydraulic fracturing monitoring or controlling software, etc. The fracture length can be used to validate the fracturing operation of the current hydraulic fracturing stage. The fracture length can also be optionally output to block 314.

Eventually, the fracture length calculator compiles a dataset at or outputs a dataset to block 314 containing the fracture lengths calculated for multiple hydraulic fracturing stages. The child well fracture length dataset can be updated with an additional value for each fracturing stage, calculated at each stage, or calculated based on data from multiple stages. The child well fracture length dataset can be output to the parent-child well interference controller, to an operator, to the hydraulic fracture monitoring or controlling software, etc.

At block 316, the fracture length calculator determines if hydraulic fracturing is complete. If the fracture length calculator determines that additional stages are to be fractured, flow continues back to block 302. From block 302, additional fracture lengths are calculated as hydraulic fracturing is detected. If the fracture length calculator determines that fracturing is complete, flow ends. The fracture length calculator can determine that hydraulic fracturing is complete based on a preselected expected number of stages, based on hydraulic fracturing design of the child well, including design included in the monitoring or controlling program for hydraulic fracturing, or the fracture length calculator can idle until triggered by the start of hydraulic fracturing operations detected at block 302.

Figure 4:
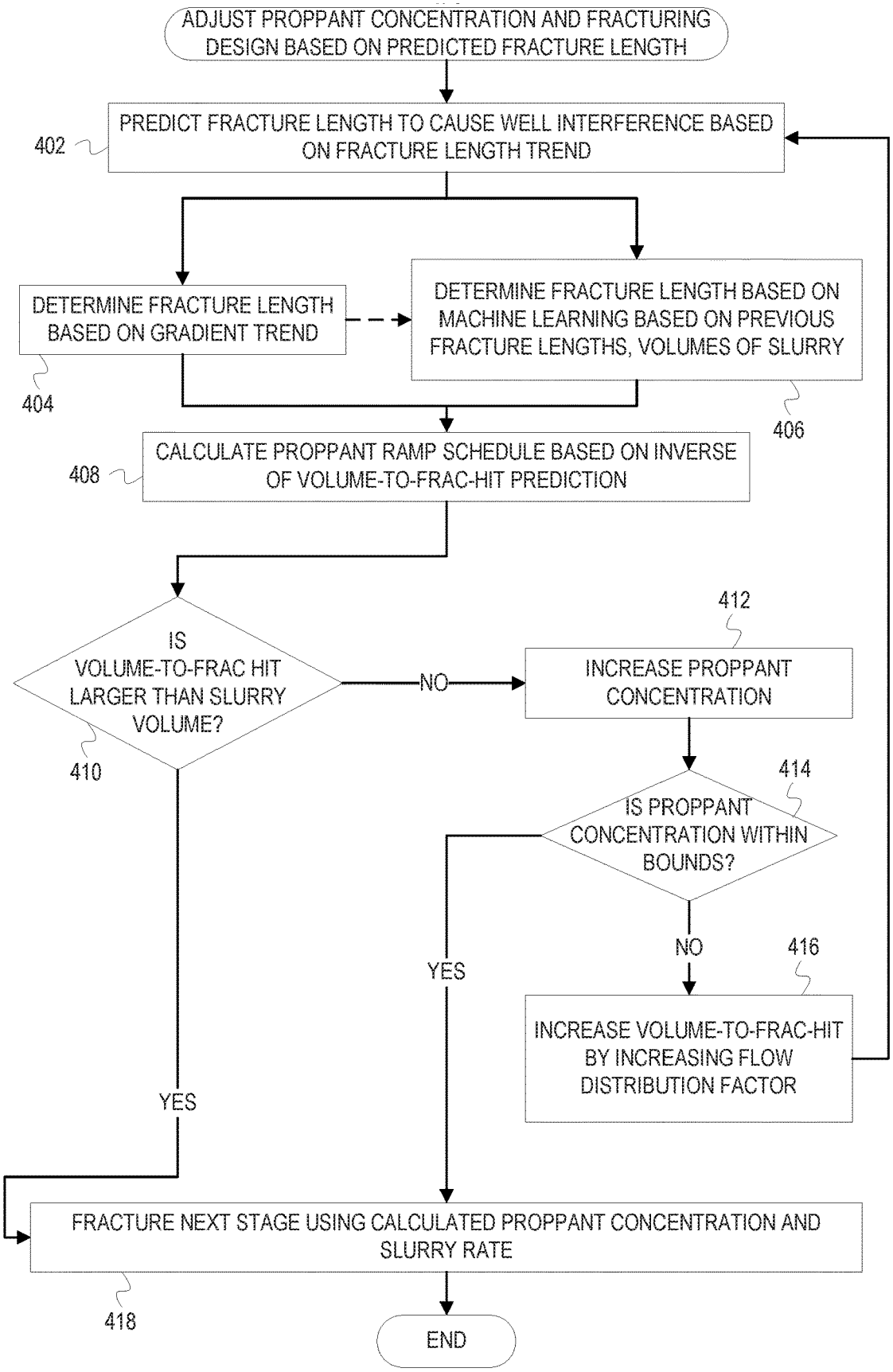
FIG. 4 is a flowchart of example operations for adjusting proppant concentration and fracturing design based on predictive fracture length determination.

FIG. 4 is a flowchart of example operations for adjusting proppant concentration and fracturing design based on predicted fracture length. The operations are described as being performed by a parent-child well interference controller, hereafter also called a well interference controller for ease of reference. However, program code naming, organization, and deployment can vary due to arbitrary programmer choice, programming language(s), platform, etc. The well interference controller can include programming to further design proppant mass or fracture stage or be a separate program or system based on input from other modules. The well interference controller can include processors or controllers to control child well treatment or slurry rate, or can output proppant ramp schedules to wellbore controllers including concentration and flow rate controllers.

At block 402, the well interference controller predicts a fracture length to cause well interference based on the fracture length trend. The well interference controller can determine that a trend exists in fracture lengths as a function of stage in a child well via various methods. The well interference controller can operate on one or more fracture length or the child well fracture length dataset output by the fracture length calculator. The well interference controller can also test for trends in the fracture length and determine that no detectable trend is found. If no trend is found, as could occur when the volume of previous fracture stage data is small at the start of hydraulic fracturing of the child well, the well interference controller can set the predicted fracture length for the current stage equal to a preselected base value, to the fracture length of the previous stage, or to a maximum or minimum value based on the physical separation of the parent and child wells and formation characteristics. From block 402, flow can continue to block 404 where the well interference controller determines a trend based on a gradient in the fracture length as a function of stage, or to block 406, where the well interference controller determines a trend in the fracture length based on machine learning or other correlations more complex than a gradient.

At block 404, the well interference controller determines the fracture length trend based on a gradient in the fracture lengths for previous stages. A gradient can be detected when two or more consecutive fracture lengths follow an increasing or decreasing trend or pattern as a function of fracture stage in the child well. The gradient can be used to calculate or predict the expected increase or decrease in the fracture length for the current fracture stage. A higher order derivative can also be calculated for three or more consecutive fracture stages, allowing the well interference controller to determine if the gradient is increasing or decreasing. A consistent trend in the first derivative of the fracture lengths (as a function of stage) can represent: a parent and child well diverging physical along the wellbores; a trend in the depleted reservoir volume surrounding the parent well due to its hydraulic fracturing; trends in the formation; etc. If a gradient trend is not detected, the well interference controller can optionally determine if other trends exist (i.e. flow can continue to block 406). Optionally, if a trend is not detected, the predicted fracture length can be selected based on interpolation or averaging of previous stage fracture lengths, the previous stage fracture length can be selected as the predicted fracture length, etc.

At block 406, the well interference controller alternately determines the fracture length trend based on machine learning or other correlation using previous stage fracture length and volume of slurry trends. A machine learning model can be trained on previous stage data, such as fracture length, treatment or slurry volume, etc. correlated to fac-hit. The machine learning model can also be trained on data from other child-parent well pairs in the same or similar formations, and can include data from the hydraulic fracturing of the parent well and its production history.

At block 408, the well interference controller calculates a proppant ramp schedule based on a volume-to-frac-hit prediction, where the volume-to-frac-hit is an inversion function of the proppant ramp schedule. The volume-to-frac-hit can be calculated using the poro-elastic model (as described in reference to Equation 12), a planar model (such as the PKN model described in reference to Equations 13-14) or any other appropriate model. The proppant ramp schedule for the current stage can be calculated based on the proppant ramp schedule for a previous stage, including based on proportional or fractional changes to the previous stage's proppant ramp schedule, or can be recalculated based on equipment limitations and predicted flow-rate based on the current fracture stage hydraulic fracturing design.

At block 410, the well interference controller determines if the predicted volume-to-frac-hit is larger than the slurry volume for the current stage. The well interference controller compares the predicted volume-to-frac-hit to the slurry volume of the calculated proppant ramp schedule. The well interference controller can determine the slurry volume by integrating the calculated proppant ramp schedule, which may be slightly different from the volume-to-frac hit prediction used to calculate the proppant ramp schedule If the volume-to-frac-hit is larger than the slurry volume, the proposed fracturing design is not predicted to cause well interference and flow continues to block 418. If the volume-to-frac-hit is smaller than the slurry volume, the proposed fracturing design is predicted to cause well interference before during the proppant ramp schedule and before the proppant mass is delivered to the hydraulic fractures of the current stage. If the volume-to-frac-hit is smaller than the slurry volume, flow continues to block 412.

At block 412, the well interference controller increases the proppant concentration in the treatment fluid or slurry to be delivered to the current hydraulic fracturing stage. The well interference controller decreases the slurry volume for the proppant ramp schedule in the current stage by increasing the amount of proppant delivered per unit volume, which corresponds to an increase in the proppant concentration. The proppant concentration increase can be calculated from the proppant mass to be delivered and the predicted volume-to-frac-hit or based on concentration limits, previously used concentrations, incremental changes in concentration, etc.

At block 414, the well interference controller determines if the proposed proppant concentration is within system limits or bounds and can be delivered. Proppant concentrations are limited by fluid and fluid flow considerations—including solubility, density, viscosity, etc.—including those of the wellbore control system and pumps and those related to the hydraulic fracturing operations. The well interference controller determines if the proposed proppant concentration is too high or too low. If the proppant concentration is within bounds, flow continues to block 418. If the proppant concentration is outside of allowable bounds, flow continues to block 416. In one or more embodiments, the well interference controller may determine that a replacement proppant would improve hydraulic fracturing versus the results of the current proppant, where a replacement proppant can be a modified form of the current proppant.

At block 416, the well interference controller increases the volume-to-frac-hit by increasing the flow-distribution factor, and recalculates the proppant concentration in the treatment fluid or slurry to be delivered based on the increased flow-distribution factor. When the proposed proppant concentration is outside of allowable bounds, the well interference controller can determine that an increase in the volume-to-frac-hit is needed for the current stage. The volume-to-frac-hit can be increased by adjusting hydraulic fracturing design, such as by increasing efficiency through the use of limited-entry design, increasing the number of clusters, etc. The flow-distribution factor may also be altered, such as by using dropping diverters to control flowrate, rheology, or dominant fracture formation. Once the design of the current fracturing stage is adjusted, flow continues to block 402 where the predicted fracture length is recalculated based on the adjusted stage design.

At block 418, the well interference controller controls or outputs to well controllers the calculated proppant concentration and treatment or slurry rate for the current stage hydraulic fracturing operation. The well interference controller can directly control the flowrates during hydraulic fracturing, including the proppant ramp schedule, or can output the proppant ramp schedule to a wellbore or rig controller program or other operation controller.

FIG. 4 is annotated with a series of numbers 402-418. These numbers represent stages of operations. Although these stages are ordered for this example, the stages illustrate one example to aid in understanding this disclosure and should not be used to limit the claims. Subject matter falling within the scope of the claims can vary with respect to the order and some of the operations.

The example operations are described with reference to a fracture length calculator and a well interference controller for consistency with the earlier figures. The name chosen for the program code is not to be limiting on the claims. Structure and organization of a program can vary due to platform, programmer/architect preferences, programming language, etc. In addition, names of code units (programs, modules, methods, functions, etc.) can vary for the same reasons and can be arbitrary.

The flowcharts are provided to aid in understanding the illustrations and are not to be used to limit scope of the claims. The flowcharts depict example operations that can vary within the scope of the claims. Additional operations may be performed; fewer operations may be performed; the operations may be performed in parallel; and the operations may be performed in a different order. For example, the operations depicted in blocks 302 and 304 can be performed in parallel or concurrently. With respect to FIG. 4, fracturing operation is not necessary. It will be understood that each block of the flowchart illustrations and/or block diagrams, and combinations of blocks in the flowchart illustrations and/or block diagrams, can be implemented by program code. The program code may be provided to a processor of a general-purpose computer, special purpose computer, or other programmable machine or apparatus.

As will be appreciated, aspects of the disclosure may be embodied as a system, method or program code/instructions stored in one or more machine-readable media. Accordingly, aspects may take the form of hardware, software (including firmware, resident software, micro-code, etc.), or a combination of software and hardware aspects that may all generally be referred to herein as a "circuit," "module" or "system." The functionality presented as individual modules/units in the example illustrations can be organized differently in accordance with any one of platform (operating system and/or hardware), application ecosystem, interfaces, programmer preferences, programming language, administrator preferences, etc.

Any combination of one or more machine readable medium(s) may be utilized. The machine-readable medium may be a machine-readable signal medium or a machine-readable storage medium. A machine readable storage medium may be, for example, but not limited to, a system, apparatus, or device, that employs any one of or combination of electronic, magnetic, optical, electromagnetic, infrared, or semiconductor technology to store program code. More specific examples (a non-exhaustive list) of the machine readable storage medium would include the following: a portable computer diskette, a hard disk, a random access memory (RAM), a read-only memory (ROM), an erasable programmable read-only memory (EPROM or Flash memory), a portable compact disc read-only memory (CD-ROM), an optical storage device, a magnetic storage device, or any suitable combination of the foregoing. In the context of this document, a machine-readable storage medium may be any tangible medium that can contain, or store a program for use by or in connection with an instruction execution system, apparatus, or device. A machine-readable storage medium is not a machine-readable signal medium.

A machine-readable signal medium may include a propagated data signal with machine readable program code embodied therein, for example, in baseband or as part of a carrier wave. Such a propagated signal may take any of a variety of forms, including, but not limited to, electromagnetic, optical, or any suitable combination thereof. A machine readable signal medium may be any machine readable medium that is not a machine readable storage medium and that can communicate, propagate, or transport a program for use by or in connection with an instruction execution system, apparatus, or device.

Program code embodied on a machine-readable medium may be transmitted using any appropriate medium, including but not limited to wireless, wireline, optical fiber cable, RF, etc., or any suitable combination of the foregoing.

The program code/instructions may also be stored in a machine readable medium that can direct a machine to function in a particular manner, such that the instructions stored in the machine readable medium produce an article of manufacture including instructions which implement the function/act specified in the flowchart and/or block diagram block or blocks.

Figure 5:
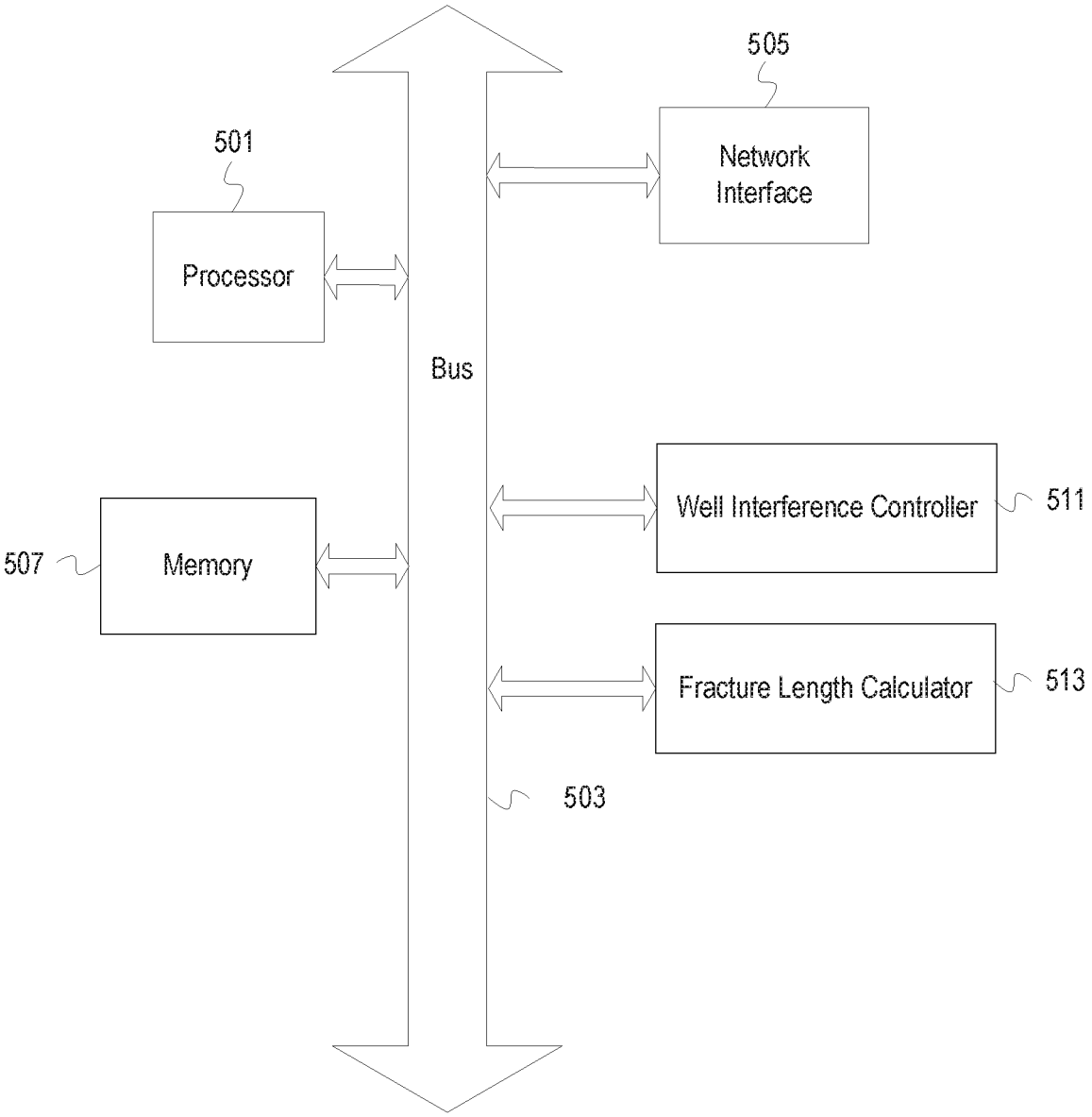
FIG. 5 depicts an example computer system for determining fracture length and controlling well interference.

FIG. 5 depicts an example computer system for determining fracture length and controlling well interference. The computer system includes a processor 501 (possibly including multiple processors, multiple cores, multiple nodes, and/or implementing multi-threading, etc.). The computer system includes memory 507. The memory 507 may be system memory or any one or more of the above already described possible realizations of machine-readable media. The computer system also includes a bus 503 and a network interface 505. The system also includes a component comprising a well interference controller 511. The well interference controller 511 can control analysis equipment, such a pressure measurement or flow-rate measurement systems. The well interference controller 511 can include a fracture length calculator 512. Alternatively, the fracture length calculator 513 can be a separate component in communication with the well interference controller 511. The well interference controller 511 and the fracture length calculator 513 can be implemented on the processor 501 or as separate components as shown. Any one of the previously described functionalities may be partially (or entirely) implemented in hardware and/or on the processor 501. For example, the functionality may be implemented with an application specific integrated circuit, in logic implemented in the processor 501, in a co-processor on a peripheral device or card, etc. Further, realizations may include fewer or additional components not illustrated in FIG. 5 (e.g., video cards, audio cards, additional network interfaces, peripheral devices, etc.). The processor 501 and the network interface 505 are coupled to the bus 503. Although illustrated as being coupled to the bus 503, the memory 507 may be coupled to the processor 501.

While the aspects of the disclosure are described with reference to various implementations and exploitations, it will be understood that these aspects are illustrative and that the scope of the claims is not limited to them. In general, techniques for calculating fracture length and controlling well interference as described herein may be implemented with facilities consistent with any hardware system or hardware systems. Many variations, modifications, additions, and improvements are possible.

Plural instances may be provided for components, operations or structures described herein as a single instance. Finally, boundaries between various components, operations and data stores are somewhat arbitrary, and particular operations are illustrated in the context of specific illustrative configurations. Other allocations of functionality are envisioned and may fall within the scope of the disclosure. In general, structures and functionality presented as separate components in the example configurations may be implemented as a combined structure or component. Similarly, structures and functionality presented as a single component may be implemented as separate components. These and other variations, modifications, additions, and improvements may fall within the scope of the disclosure.

Example Embodiments

Embodiment 1: A method comprising: determining an interference time for a first hydraulic fracturing stage of a child well based, at least in part, on a measured pressure response in a parent well; determining an interference volume for the first hydraulic fracturing stage of the child well based, at least in part, on the interference time; and determining a first fracture length between the child well and a depleted reservoir region of the parent well for the first hydraulic fracturing stage based, at least in part, on the interference volume.

Embodiment 2: The method of embodiment 1, wherein determining an interference volume further comprises: determining the interference volume based, at least in part, on an integral of a treatment rate in the child well over the interference time.

Embodiment 3: The method of embodiment 1 or 2 further comprising: determining a flow-distribution factor for the first hydraulic fracturing stage.

Embodiment 4: The method of embodiment 3, wherein determining a flow-distribution factor comprises determining a flow-distribution factor based on a poro-elastic model.

Embodiment 5: The method of embodiment 3, wherein determining a flow-distribution factor comprises determining a flow-distribution factor based on a planar model.

Embodiment 6: The method of any one of embodiments 3 to 5, wherein determining the first fracture length comprises determining the first fracture length based on the flow-distribution factor.

Embodiment 7: The method of any one of embodiments 1 to 6, further comprising: predicting a second fracture length for a second hydraulic fracturing stage based, at least in part, on the first fracture length.

Embodiment 8: The method of embodiment 7 wherein the second hydraulic fracturing stage comprises at least one of a hydraulic fracturing stage in the child well or a hydraulic fracturing stage in a second well.

Embodiment 9: The method of embodiment 7 or 8, wherein predicting the second fracture length comprises: determining a trend one or more first fracture lengths.

Embodiment 10: The method of any one of embodiments 7 to 9, further comprising: predicting a volume-to-frac-hit based on the second fracture length.

Embodiment 11: The method of embodiment 10, further comprising: calculating a proppant ramp schedule based on the predicted volume-to-frac hit.

Embodiment 12: The method of embodiment 11, further comprising: adjusting a proppant concentration based, at least in part, on a comparison between the predicted volume-to-frac-hit and a slurry volume, wherein the slurry volume is determined based on the calculated proppant ramp schedule.

Embodiment 13: The method of embodiments 12, further comprising: determining if the adjusted proppant concentration is allowable; and if the adjusted proppant concentration is not allowable, increasing the predicted volume-to-frac-hit by adjusting one or more hydraulic fracturing parameters.

Embodiment 14: A non-transitory, computer-readable medium having instructions stored thereon that are executable by a computing device, the instructions to: determine an interference time for a hydraulic fracturing stage of a child well based, at least in part, on a measured pressure response in a parent well; determine an interference volume for the hydraulic fracturing stage of a child well based, at least in part, on the interference time and an integral of a treatment rate in the child well; and determine a fracture length between the child well and a depleted reservoir region of the parent well for the hydraulic fracturing stage based, at least in part, on the interference volume.

Embodiment 15: The non-transitory, computer-readable medium of embodiment 14, wherein the instructions further comprise instructions to: determine a flow-distribution factor for the hydraulic fracturing stage based on at least one of a poro-elastic model and a planar model; and wherein instructions to determine the fracture length comprise instruction to determine the fracture length based on the flow-distribution factor.

Embodiment 16: The non-transitory, computer-readable medium of embodiment 14 or 15, wherein the instructions further comprise instructions to: predict a fracture length for a future hydraulic fracturing stage based, at least in part, on the determined fracture length for one or more hydraulic fracturing stages; predict a volume-to-frac-hit based on the predicted fracture length; and calculate a proppant ramp schedule based on the predicted volume-to-frac hit.

Embodiment 17: The non-transitory, computer-readable medium of embodiment 16, wherein the instructions further comprise instructions to: adjust a proppant concentration based, at least in part, on a comparison between the predicted volume-to-frac-hit and a slurry volume, wherein the slurry volume is determined based on the calculated proppant ramp schedule; and determine if the adjusted proppant concentration is allowable; and if the adjusted proppant concentration is not allowable, increase the predicted volume-to-frac-hit by adjusting one or more hydraulic fracturing parameter for the future stage.

Embodiment 18: An apparatus comprising: a processor; and a computer-readable medium having instructions stored thereon that are executable by the processor to cause the processor to, determine an interference time for a hydraulic fracturing stage of a child well based, at least in part, on a measured pressure response in a parent well; determine an interference volume for the hydraulic fracturing stage of a child well based, at least in part, on the interference time and an integral of a treatment rate in the child well; determine a flow-distribution factor for the hydraulic fracturing stage based on at least one of a poro-elastic model and a planar model; and determine a fracture length between the child well and a depleted reservoir region of the parent well for the hydraulic fracturing stage based, at least in part, on the interference volume and the flow-distribution factor.

Embodiment 19: The apparatus of embodiment 18, wherein the instructions comprise instructions executable by the processor to cause the processor to: predict a fracture length for a future hydraulic fracturing stage based, at least in part, on the determined fracture length for one or more hydraulic fracturing stages; predict a volume-to-frac-hit based on the predicted fracture length; and calculate a proppant ramp schedule based on the predicted volume-to-frac hit.

Embodiment 20: The apparatus of claim 19, wherein the instructions comprise instructions executable by the processor to cause the processor to: adjust a proppant concentration based, at least in part, on a comparison between the predicted volume-to-frac-hit and a slurry volume, wherein the slurry volume is determined based on the calculated proppant ramp schedule; and determine if the adjusted proppant concentration is allowable; and if the adjusted proppant concentration is not allowable, increase the predicted volume-to-frac-hit by adjusting one or more hydraulic fracturing parameter for the future stage.

TERMINOLOGY

As used herein, the term "or" is inclusive unless otherwise explicitly noted. Thus, the phrase "at least one of A, B, or C" is satisfied by any element from the set {A, B, C} or any combination thereof, including multiples of any element.

The invention claimed is:

1. A method comprising:

determining an interference time for a first hydraulic fracturing stage of a child well based, at least in part, on a measured pressure response in a parent well;

determining an interference volume for the first hydraulic fracturing stage of the child well based, at least in part, on the interference time; and determining a first fracture length between the child well and a depleted reservoir region of the parent well for the first hydraulic fracturing stage based, at least in part, on the interference volume; and estimating a distance to a depleted reservoir boundary of the depleted reservoir region based, at least in part, on the first fracture length.

2. The method of claim 1, wherein determining the interference volume further comprises:

determining the interference volume based, at least in part, on an integral of a treatment rate in the child well over the interference time.

3. The method of claim 1 further comprising:

determining a flow-distribution factor for the first hydraulic fracturing stage, wherein the flow-distribution factor is a measure of a uniformity of a fluid transport through the first fracture length.

4. The method of claim 3, wherein determining the flow-distribution factor comprises determining the flow-distribution factor based on a poro-elastic model.

5. The method of claim 3, wherein determining the flow-distribution factor comprises determining the flow-distribution factor based on a planar model.

6. The method of claim 3, wherein determining the first fracture length comprises determining the first fracture length based on the flow-distribution factor.

7. The method of claim 1, further comprising:

predicting a second fracture length for a second hydraulic fracturing stage based, at least in part, on the first fracture length.

8. The method of claim 7 wherein the second hydraulic fracturing stage comprises at least one of a hydraulic fracturing stage in the child well or a hydraulic fracturing stage in a second well.

9. The method of claim 7, wherein predicting the second fracture length comprises determining a trend within one or more fracture lengths.

10. The method of claim 7, further comprising:

predicting a volume-to-frac-hit based on the second fracture length.

11. The method of claim 10, further comprising:

calculating a proppant ramp schedule based on the predicted volume-to-frac hit.

12. The method of claim 11, further comprising:

adjusting a proppant concentration based, at least in part, on a comparison between the predicted volume-to-frac-hit and a slurry volume, wherein the slurry volume is determined based on the calculated proppant ramp schedule.

13. The method of claim 12, further comprising:

determining if the adjusted proppant concentration is allowable; and if the adjusted proppant concentration is not allowable, increasing the predicted volume-to-frac-hit by adjusting one or more hydraulic fracturing parameters.

14. A non-transitory, computer-readable medium having instructions stored thereon that are executable by a computing device, the instructions to:

determine an interference time for a hydraulic fracturing stage of a child well based, at least in part, on a measured pressure response in a parent well;

determine an interference volume for the hydraulic fracturing stage of the child well based, at least in part, on the interference time and an integral of a treatment rate in the child well; and determine a fracture length between the child well and a depleted reservoir region of the parent well for the hydraulic fracturing stage based, at least in part, on the interference volume; and estimate a distance to a depleted reservoir boundary of the depleted reservoir region based, at least in part, on the determined fracture length.

15. The non-transitory, computer-readable medium of claim 14, wherein the instructions further comprise instructions to:

determine a flow-distribution factor for the hydraulic fracturing stage based on at least one of a poro-elastic model and a planar model, wherein the flow-distribution factor is a measure of a uniformity of a fluid transport through the determined fracture length; and wherein the instructions to determine the fracture length comprise instructions to determine the fracture length based on the flow-distribution factor.

16. The non-transitory, computer-readable medium of claim 14, wherein the instructions further comprise instructions to:

predict a fracture length for a future hydraulic fracturing stage based, at least in part, on the determined fracture length for one or more hydraulic fracturing stages;

predict a volume-to-frac-hit based on the predicted fracture length; and calculate a proppant ramp schedule based on the predicted volume-to-frac hit.

17. The non-transitory, computer-readable medium of claim 16, wherein the instructions further comprise instructions to:

adjust a proppant concentration based, at least in part, on a comparison between the predicted volume-to-frac-hit and a slurry volume, wherein the slurry volume is determined based on the calculated proppant ramp schedule; and determine if the adjusted proppant concentration is allowable; and if the adjusted proppant concentration is not allowable, increase the predicted volume-to-frac-hit by adjusting one or more hydraulic fracturing parameters for the future hydraulic fracturing stage.

18. An apparatus comprising:

a processor; and a computer-readable medium having instructions stored thereon that are executable by the processor to cause the apparatus to, determine an interference time for a hydraulic fracturing stage of a child well based, at least in part, on a measured pressure response in a parent well;

determine an interference volume for the hydraulic fracturing stage of the child well based, at least in part, on the interference time and an integral of a treatment rate in the child well;

determine a flow-distribution factor for the hydraulic fracturing stage based on at least one of a poro-elastic model and a planar model, wherein the flow-distribution factor is a measure of a uniformity of a fluid transport through a fracture; and determine a fracture length between the child well and a depleted reservoir region of the parent well for the hydraulic fracturing stage based, at least in part, on the interference volume and the flow-distribution factor; and estimate a distance to a depleted reservoir boundary of the depleted reservoir region based, at least in part, on the determined fracture length.

19. The apparatus of claim 18, wherein the instructions comprise instructions executable by the processor to cause the processor to:

predict a fracture length for a future hydraulic fracturing stage based, at least in part, on the determined fracture length for one or more hydraulic fracturing stages;

predict a volume-to-frac-hit based on the predicted fracture length; and calculate a proppant ramp schedule based on the predicted volume-to-frac hit.

20. The apparatus of claim 19, wherein the instructions comprise instructions executable by the processor to cause the processor to:

adjust a proppant concentration based, at least in part, on a comparison between the predicted volume-to-frac-hit and a slurry volume, wherein the slurry volume is determined based on the calculated proppant ramp schedule; and determine if the adjusted proppant concentration is allowable; and if the adjusted proppant concentration is not allowable, increase the predicted volume-to-frac-hit by adjusting one or more hydraulic fracturing parameters for the future hydraulic fracturing stage.

* * * * *